US008601638B2

(12) United States Patent
Chung et al.

(10) Patent No.: US 8,601,638 B2
(45) **Date of Patent: *Dec. 10, 2013**

(54) STEAM GENERATOR, METHOD OF CONTROLLING THE SAME, CLEANER USING THE SAME AND METHOD OF CONTROLLING THE CLEANER

(75) Inventors: Choon Myun Chung, Gwangnyeong-si (KR); Jeong Ho Lee, Goyang-si (KR); Hyoung Jun Kim, Seoul (KR); Sung Il Park, Anyang-si (KR)

(73) Assignee: LG Electronics Inc., Seoul (KR)

( * ) Notice: Subject to any disclaimer, the term of this patent is extended or adjusted under 35 U.S.C. 154(b) by 382 days.

This patent is subject to a terminal disclaimer.

(21) Appl. No.: 12/886,173

(22) Filed: Sep. 20, 2010

(65) Prior Publication Data

US 2011/0088199 A1 Apr. 21, 2011

Related U.S. Application Data

(62) Division of application No. 11/608,555, filed on Dec. 8, 2006, now Pat. No. 7,917,991.

(30) Foreign Application Priority Data

Dec. 9, 2005 (KR) ..... 10-2005-0120549

(51) Int. Cl.
*A47L 11/34* (2006.01)

(52) U.S. Cl.
USPC ..... 15/320; 15/321

(58) Field of Classification Search
USPC ..... 15/320–322, 339
See application file for complete search history.

(56) References Cited

U.S. PATENT DOCUMENTS

| | | | | |
|---|---|---|---|---|
| 4,829,624 | A | 5/1989 | Grzywna et al. | |
| 4,956,544 | A | 9/1990 | Sayward | |
| 5,305,415 | A | 4/1994 | Stevens | |
| 5,749,120 | A * | 5/1998 | Amoretti | 15/339 |
| 5,920,952 | A | 7/1999 | Baldacci | |
| 6,148,144 | A | 11/2000 | Milanese | |
| 6,571,421 | B1 | 6/2003 | Sham et al. | |
| 6,584,990 | B2 | 7/2003 | Shaw | |
| 7,917,991 | B2 * | 4/2011 | Chung et al. | 15/321 |
| 2002/0144374 | A1 * | 10/2002 | Tsen | 15/321 |

FOREIGN PATENT DOCUMENTS

| | | |
|---|---|---|
| EP | 1027855 | 8/1994 |
| EP | 0624998 | 11/1994 |
| EP | 0638767 | * 2/1995 |
| EP | 0942230 | 9/1999 |
| EP | 1 195 127 | 4/2002 |
| EP | 1479970 | 11/2004 |
| RU | 2073172 | 2/1997 |
| RU | 2091053 | 9/1997 |
| RU | 2099635 | 12/1997 |
| SU | 1590829 | 9/1990 |
| WO | WO 00/06945 | 2/2000 |
| WO | WO 01/53596 | 7/2001 |
| WO | WO 2005/058118 | 6/2005 |

* cited by examiner

*Primary Examiner* — Robert Scruggs
(74) *Attorney, Agent, or Firm* — McKenna Long & Aldridge, LLP

(57) ABSTRACT

A steam generator is provided that includes an external case having an opening that allows an internal space to communicate with an external environment. Additionally, the steam generator may be provided with a supplier that supplies water to the internal space, a heater provided to the opening to generate steam, an outlet pipe having a first side that communicates with the external environment to discharge steam, and a steam discharge controller provided to a second side of the outlet pipe to open/close the outlet pipe according to a presence or absence of a discharge of the steam.

7 Claims, 8 Drawing Sheets

STEAM GENERATOR, METHOD OF CONTROLLING THE SAME, CLEANER USING THE SAME AND METHOD OF CONTROLLING THE CLEANER

This application is a divisional application of, and claims priority to, U.S. application Ser. No. 11/608,555, filed Dec. 8, 2006 now U.S. Pat. No. 7,917,991 and claims the benefit of Korean Patent Application No. 10-2005-0120549, filed on Dec. 9, 2005, each of which is hereby incorporated by reference as if fully set forth herein.

BACKGROUND OF THE INVENTION

1. Field of the Invention

The present invention relates to a steam generator and cleaner using the same, and more particularly, a steam generator, method of controlling the same, cleaner using the same and method of controlling the cleaner. Although the present invention is suitable for a wide scope of applications, it is particularly suitable for enhancing a structure of the steam generator and enabling steam cleaning and vacuum cleaning using the structure-enhanced steam generator.

2. Discussion of the Related Art

Generally, a vacuum cleaner collects dust in a manner of sucking air containing particles such as dust and the like and separating the particles from the sucked air. In the following description, a cleaner's function of sucking air and removing particles from the suck-in air is named a vacuum cleaning function.

The vacuum cleaner consists of a head body sucking air, a cleaner body having a dust collector collecting dust by separating particles from the sucked air, and a connecting pipe guiding the particles sucked by the head body to the cleaner body.

The cleaner body is provided with an air sucking device generating an air sucking force and a dust collector container loading part, in which a dust collector container is loaded, is provided to a prescribed position of the cleaner body.

Drive wheels are provided to both rear sides of the cleaner body, respectively. And, a caster of a rotational material for a direction change of the cleaner body is provided to a front bottom side of the cleaner body.

Meanwhile, a general steam cleaner is a cleaning device facilitating filth or dirt to be removed from a floor by supplying water to a floorcloth attached to a bottom side of the steam cleaner and heating the floorcloth using hot steam. In the following description, a cleaner's function of cleaning a floor using steam is named a steam cleaning function.

The steam cleaner consists of a cleaner body moving along a floor, a steam generator provided within the cleaner body to generate steam, and a grip member playing a role as a grip in case that a user attempts to move the cleaner body.

A floorcloth is attached to a bottom side of the cleaner body to clean a floor. So, the floorcloth attached to the bottom side of the cleaner body to clean the filthy floor while the cleaner body is moving.

The steam generator is provided with a water container supplying water and a heating device changing water into steam.

However, since the steam generated from the steam generator is discharged via a steam outlet that is always open, a steam pressure is lowered in carrying out a steam cleaning.

And, since the steam outlet is always open despite not performing the steam cleaning, a smell within the steam generator leaks externally.

Meanwhile, a heating member may be overheated in driving the heating device. To prevent this, a thermostat or the like is installed.

However, since the thermostat measures not a temperature of the heating member but a water temperature, it is unable to correctly measure whether the heating member is overheated. For instance, since the water temperature is maintained almost at 100° C. in driving the steam generator, it is unable to know whether the heating member is overheated.

Besides, since the thermostat is provided within the steam generator apart from the heating device, assembly productivity in manufacturing a home appliance is lowered. And, if the thermostat or the heating device is out of order, other parts need to be disassembled for repair. Hence, it is difficult to repair the thermostat or the heating device since.

SUMMARY OF THE INVENTION

Accordingly, the present invention is directed to a steam generator, method of controlling the same, cleaner using the same and method of controlling the cleaner that substantially obviate one or more problems due to limitations and disadvantages of the related art.

An object of the present invention is to provide a steam generator, method of controlling the same, cleaner using the same and method of controlling the cleaner, by which a discharge pressure of stem can be controlled.

Another object of the present invention is to provide a steam generator, method of controlling the same, cleaner using the same and method of controlling the cleaner, by which a discharge of steam or smell can be controller.

Another object of the present invention is to provide a steam generator and cleaner using the same, by which a heating member can be prevented from being overheated by precisely detecting a temperature of the heating member.

A further object of the present invention is to provide a steam generator and cleaner using the same, by which assembly productivity is enhanced and by which repair is facilitated.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a steam generator according to the present invention includes an external case having an opening enabling an internal space to communicate with an external environment and a supply part supplying water to the internal space, a heater provided to the opening to generate steam, an outlet pipe having one side communicate with the external environment to discharge the steam generated by the heater outside the external case, and a steam discharge controller provided to the other side of the outlet pipe to open/close the outlet pipe according to a presence or non-presence of a discharge of the steam.

Preferably, the steam discharge controller includes a steam discharge case having a prescribed space inside wherein the outlet pipe communicates with one side of a bottom of the steam discharge case and wherein the bottom downwardly inclines toward the outlet pipe and a mass member movable along the bottom of the steam discharge case.

More preferably, the steam discharge case is provided with a case hole communicating with the outlet pipe and a perforated hole communicating with the internal space of the external case.

More preferably, the steam discharge case is further provided with a motion guide guiding a motion of the mass member. More preferably, the mass member is configured spherical.

Preferably, the steam discharge controller includes a switching member opening/closing the outlet pipe, a driver driving the switching member, and a control unit controlling the driver.

More preferably, the stem discharge controller further includes a pressure sensor measuring a steam pressure within the case.

Preferably, the heater includes a heating member heating water to generate steam, a fixing part assembly fixing the heating member to the external case to seal the opening, a thermostat loaded in the fixing part assembly to prevent an overheating of the heating member, and a heat transfer member transferring heat of the heating member to the thermostat.

More preferably, the steam generator further includes a sealing member between the opening and the fixing part assembly for sealing in-between.

More preferably, the fixing part assembly includes an inner bracket provided within the external case, an outer bracket provided outside the external case, an intermediate connecting member fitted into the opening to be provided between the inner and outer brackets, and a fastener assembled to the inner and outer brackets. More preferably, a loading part recessed to have the thermostat loaded therein is provided to the intermediate connecting member.

In another aspect of the present invention, a cleaner includes the steam generator of claim 1, a cleaning member provided under a steam outlet of an outlet pipe provided to the steam generator, a cleaner body having an air sucking means operated independent from the steam generator, and a dust collector detachably assembled to the cleaner body to separate particles from air sucked by the air sucking means.

In another aspect of the present invention, a cleaner includes a heater including a heating member heating water to generate steam, a thermostat preventing an overheating of the heating member, and a fixing part assembly having a loading part recessed to enable the thermostat to be loaded therein in the vicinity of the heating member, an outlet pipe discharging the steam generated by the heater, a steam discharge controller provided to one side of the outlet pipe to open/close the outlet pipe according to a presence or non-presence of a discharge of the steam, and a cleaning member provided under a steam outlet of the outlet pipe.

In another aspect of the present invention, a method of controlling a steam generator includes the steps of measuring a steam pressure within an external case using a pressure sensor provided to the steam generator, deciding a presence or non-presence of a steam discharge by comparing the measured steam pressure to a preset steam pressure, and controlling a switching member for the steam discharge according to a result of the deciding step.

Preferably, in the switching member controlling step, if the steam pressure measured by the pressure sensor is greater than the preset steam pressure, the switching member is opened. If the steam pressure measured by the pressure sensor is smaller than the preset steam pressure, the switching member is closed.

In a further aspect of the present invention, a method of controlling a cleaner includes the step of generating steam using a steam generator, measuring a steam state within a steam generator using a measurement sensor provided to the steam generator, controlling a switching member for a discharge of the steam by deciding whether to discharge the steam according to the steam state, and operating an air sucking means independent from an operation of the steam generator.

It is to be understood that both the foregoing general description and the following detailed description of the present invention are exemplary and explanatory and are intended to provide further explanation of the invention as claimed.

BRIEF DESCRIPTION OF THE DRAWINGS

The present invention is further described in the detail description which follows, in reference to the noted plurality of drawings, by way of non-limiting examples of preferred embodiments of the present invention, in which like characters represent like elements throughout the several views of the drawings, and wherein.

DETAILED DESCRIPTION OF THE INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

First of all, a cleaner according to one preferred embodiment of the present invention is explained in detail as follows.

Figure 1:
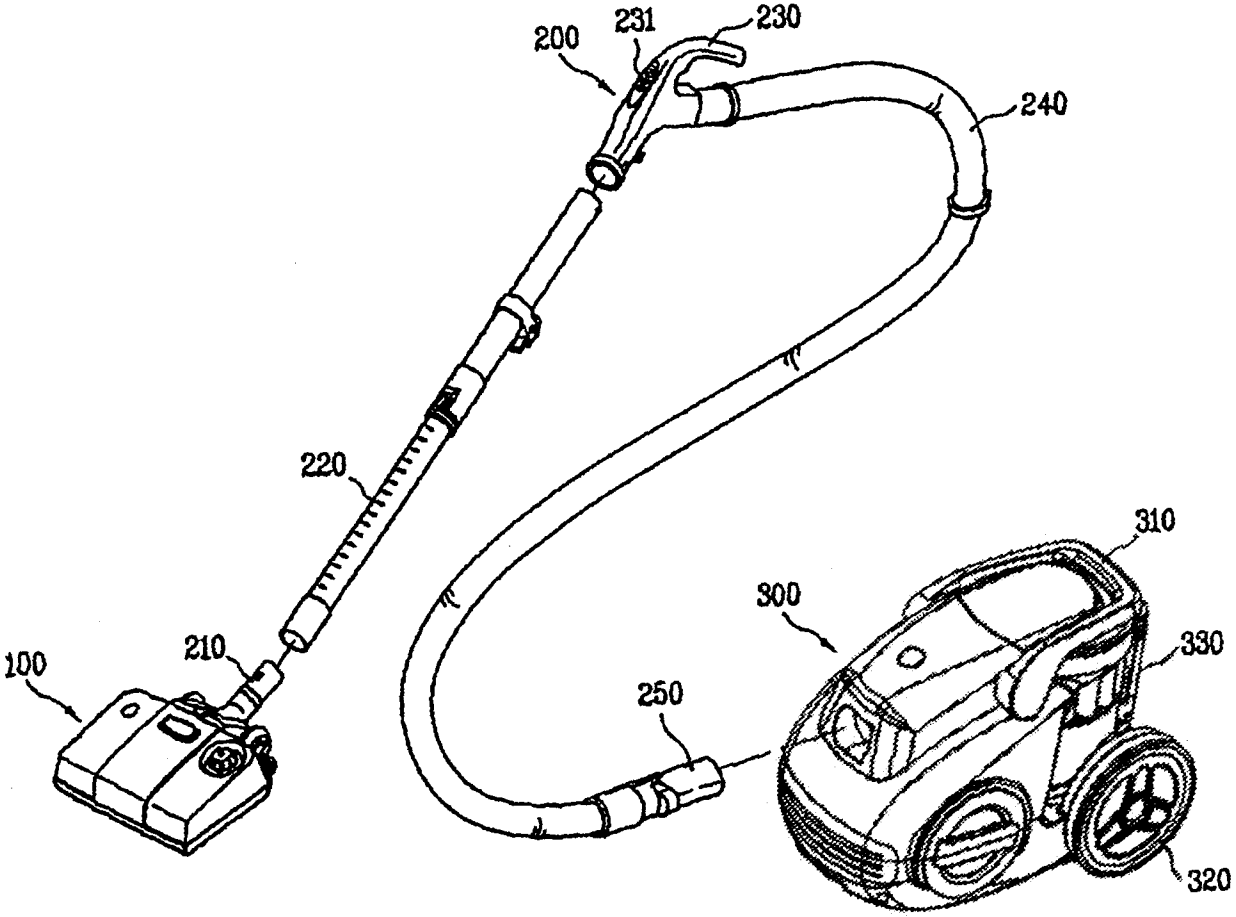
FIG. 1 is a perspective diagram of a cleaner according to one embodiment of the present invention.

FIG. 1 is a perspective diagram of a cleaner according to one embodiment of the present invention. A cleaner according to the present invention is explained with reference to FIG. 1 as follows.

Referring to FIG. 1, a cleaner according to the present invention is provided with a steam cleaning function and a vacuum cleaning function. The functions can be operated simultaneously or individually.

The cleaner includes a head body 100 moving along a floor to be cleaned, a cleaner body 300 separated from the head body 100, and a connector 200 connecting the head body 100 and the cleaner body 300 together.

The connector 200 helps guide polluted (e.g., containing debris) air sucked by the head body 100 to the cleaner body 300. Additionally, the connector 200 may include a first connecting pipe 210 directly connected with the head body 100, an extension pipe 220 connected with the first connecting pipe 210, an extension pipe grip 230 provided to a top side of the extension pipe 220, a connecting hose 240 connected to the extension pipe grip 230, and a second connecting pipe 250 connecting the connecting hose 240 and the cleaner body 300 together.

The first connecting pipe 210 extends from the head body 100. The extension pipe 220 includes at least one or more extension pipes and its height and/or length may be adjustable. A control panel 231 may be provided on the extension pipe grip 230 to control an operation of the cleaner. Therefore, if a user attempts to activate the steam cleaning function only, the extension pipe grip 230 is separated from the connecting hose 240. A portable power supply device may be provided to the head body 100. Optionally, the head body 100 may be connected to an external power supply source.

Each of the first connecting pipe 210, the second connecting pipe 250 and the extension pipe 220 may be formed of a hard material, whereas the connecting hose 240 may be formed of a flexible material. Further, a hook may be provided on each of the first connecting pipe 210, the extension pipe 220, the extension pipe grip 230, the connecting hose 240 and the second connecting pipe 250. Of course, the respective elements of the connector may be locked by screw locks or both of the hook and screw locks.

A fan-motor assembly (not shown in the drawing) may be provided within the cleaner body 300 to suck air into the cleaner body 300 for a forcible flow of the sucked-in air. If the vacuum cleaning mode is selected by the user, the fan-motor assembly may be activated so that particles (or debris) piled up on the floor can be sucked into the head body 100 together with air.

A cleaner grip 310 may be provided to an upper end of the cleaner body 300 to carry the cleaner body 300. And, wheels 320 may be rotatably provided to both sides of a rear side of the cleaner body 300 to enable the cleaner body 300 to smoothly move along the floor, respectively. A caster (not shown in the drawing) formed of a rotatable material may be assembled to a front side of a bottom of the cleaner body 300 for a direction change of the cleaner body 300. And, a dust collector 330 may be detachably provided to the cleaner body 300 to separate and store particles from the sucked-in air.

Figure 2:
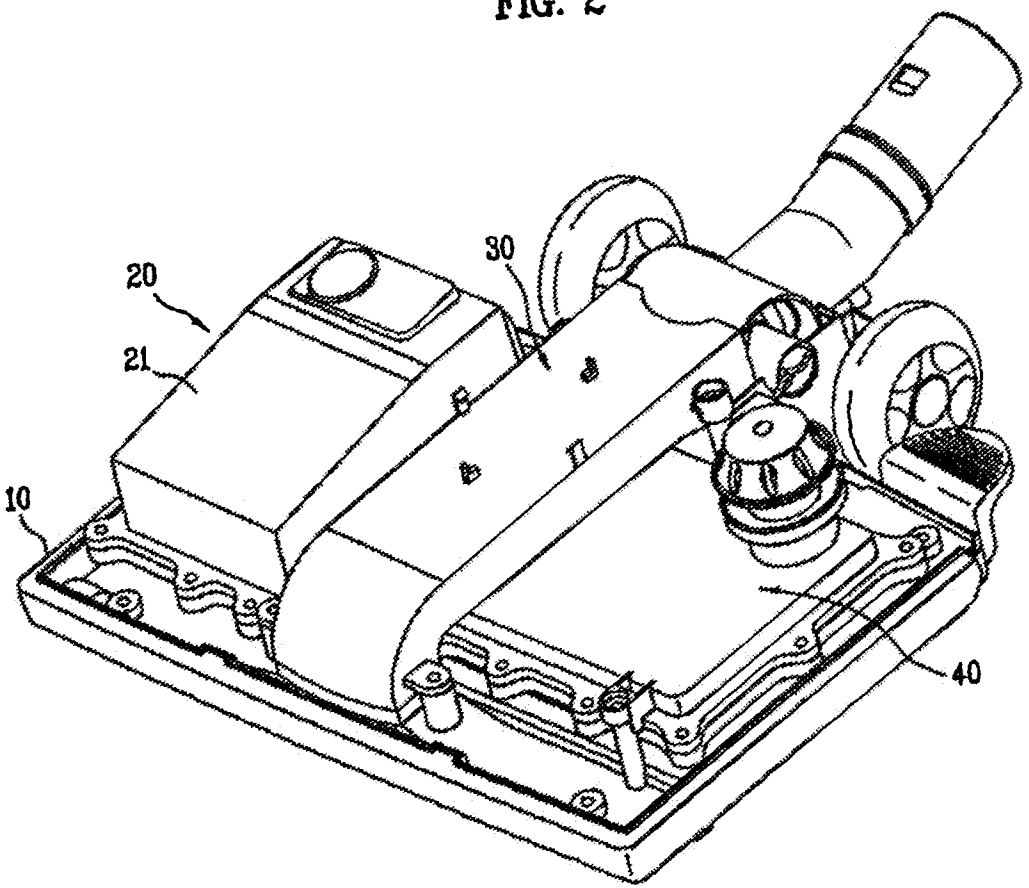
FIG. 2 is a schematic perspective diagram of a head body shown in FIG. 1.
Figure 3:
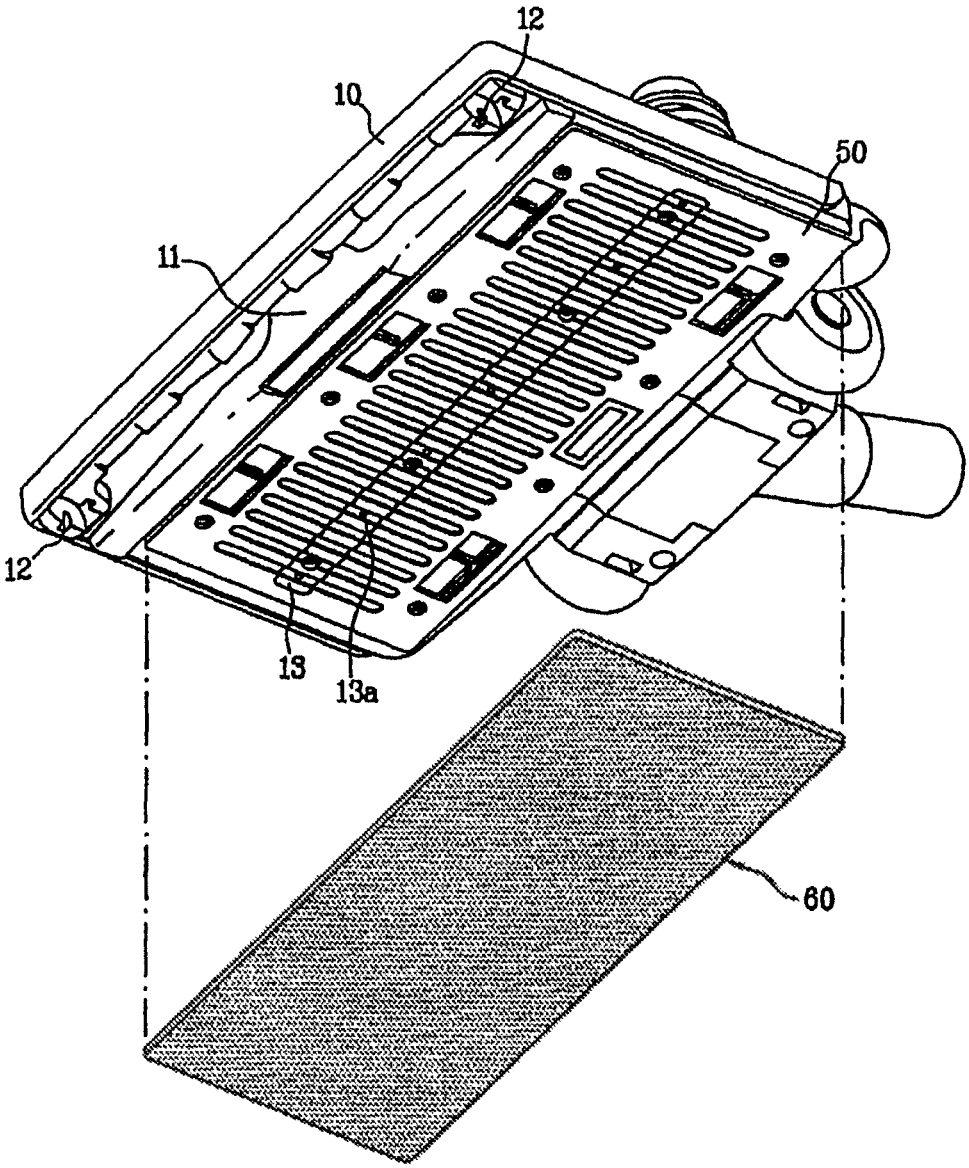
FIG. 3 is a perspective diagram of a bottom side of a head body shown in FIG. 1.

FIG. 2 is a schematic perspective diagram of an internal configuration of a head body shown in FIG. 1, and FIG. 3 is a perspective diagram of a bottom side of a head body shown in FIG. 1.

Referring to FIG. 2 and FIG. 3, the head body 100 includes a base member 10 opposing a floor to be cleaned, a steam generator 20 provided to one side of a top surface of the base member 10 to generate steam, an air intake pipe 30 playing a role as a passage for air suction, and a water tank 40 supplying water to the steam generator 20.

Additionally, the head body 10 may be configured to include an agitator (not shown in the drawings) shaking the dust off the floor or carpet, a motor (not shown in the drawings) driving the agitator, and a belt (not shown in the drawings) transferring a rotational force of the motor to the agitator.

The steam generator 20 may be provided to one side of the top surface of the base member 10 and the water tank 40, communicating with the steam generator 20, may be provided to the other side of the top surface of the base member 10. Additionally, the air intake pipe 30 may be provided to a middle part of the top surface of the base member 10, for example, between the steam generator 20 and the water tank 40.

Additionally, an auxiliary wheel ((not shown in the drawings) may be provided to a front end of the bottom of the base member 10 for a movement of the head body 100. The auxiliary wheel may be inserted in a wheel recess 12 provided to the bottom side of the base member 10.

The air intake pipe 30 may be configured to communicate with a base opening 11, and the base opening 11 may be provided on a front end of the bottom surface of the base member 10 with reference to a cleaning progress direction of the cleaner.

A connecting plate 50 may be provided on a rear end of the bottom surface of the base member 10 to play a role as a medium to assemble the base member 10 and a cleaning member 60 together. In particular, a top surface of the connecting plate 50 may be detachably attached to the bottom surface of the base member 10 and the cleaning member 60 may be assembled to the bottom surface of the connecting plate 50 to perform the steam cleaning.

Further, a spray guide 13 (having steam discharge holes 13*a*) may be provided to the bottom side of the base member 10 to discharge the steam generated from the steam generator 20.

A configuration of the steam generator and a process for controlling whether to discharge the steam generated from the steam generator according to the present invention are explained with reference to FIG. 4A, FIG. 4B and FIG. 5 as follows.

First of all, the steam generator 20 may include an external case 21 configuring an exterior, a heater 400 to generate steam within the external case 21, an outlet pipe 23 via which the steam is discharged, and a steam discharge controller opening/closing the outlet pipe 23 according to a presence or non-presence of a discharge of the steam.

An opening 25 may be provided to one side of a lateral side of the external case 21 to enable an internal space of the external case 21 to communicate with an external environment, and a water supply part 22 may be provided to a top side of the external case 21 to enable water to be supplied to the inner space of the external case 21.

An outlet pipe 23 may be provided within the external case 21 to extend from a bottom side of the external case 21. Additionally, a steam outlet 23*a* may be provided on a lower end of the outlet pipe 23, i.e., the bottom side of the external case 21 at which the outlet pipe 23 is foamed.

Meanwhile, the steam discharge controller may be provided on an upper end of the outlet pipe 23. The steam discharge controller includes a steam discharge case 510 provided over the outlet pipe 23 and a mass member 520 provided with the steam discharge case 510.

A prescribed space may be provided within the steam discharge case 510 and a prescribed incline 517 may be provided to a bottom of the steam discharge case 510. In particular, the bottom of the steam discharge case 510 may have a concave shape.

Further, the steam discharge case 510 may be provided with a case hole 511 that communicates with the outlet pipe 23 and perforated holes 513 that communicate with the internal space of the external case 21. For example, the case hole 511 may be provided proximate a center of the incline 517 and the perforated holes 513 may be provided on an entire surface of the steam discharge case 510.

The case hole 511 may be configured to be smaller than a cross-section of the mass member 520. So, if the mass member 520 is placed at a top of the case hole 511, and more particularly, on one end of the outlet pipe 23, the outlet pipe 23 may be completely covered with the mass member 520. Hence, the steam within the steam discharge case may be prevented from being discharged from the external case 21 via the outlet pipe 23.

Additionally, a motion guide 515 may be provided on the steam discharge case 510 to guide a movement of the mass member 520. For example, the motion guide 515 may project from a bottom surface of the steam discharge case 510 and extend longitudinally in a front-to-rear direction of the head body 100. Therefore, if the head body 100 proceeds in the front-to-rear direction, the mass member 520 moves along the motion guide 515 provided to both side of the case hole 511.

The mass member 520 may be configured to have a spherical shape to roll within the internal space of the steam discharge case 510. Preferably, the mass member 520 has a mass enough to be moved by a user's force in performing the steam cleaning. Alternatively, the mass member 520 may have a plate shape, which may be configured to slide on the case hole 511.

An incline degree of the incline 517 and the mass of the mass member 520 are associated with a time taken for the mass member 520 to reach an upper part of the case hole 511 when the steam cleaning is over. Therefore, the incline degree of the incline 517 and the mass of the mass member 520 may be decided by considering the time it takes for the moving mass member 520 to halt.

Optionally, the steam discharge controller may include a holder (not shown in the drawings) to prevent a motion of the mass member 520 while a steam cleaning is not in progress.

A process for the steam discharge controller to control the steam discharge is explained with reference to FIG. 4A and FIG. 4B as follows.

Figure 4A:
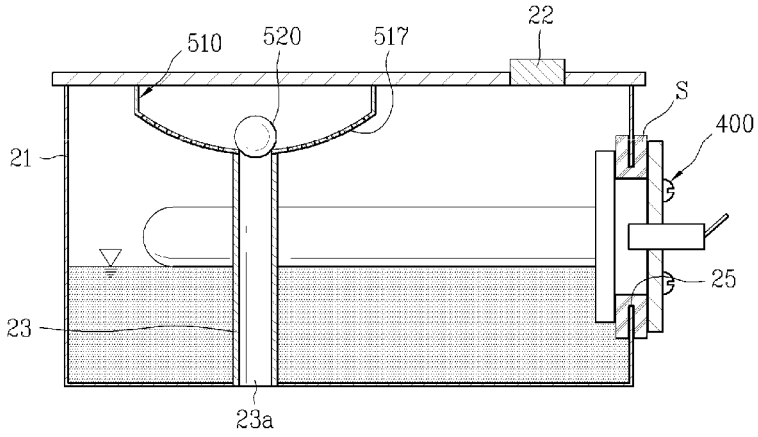
FIG. 4A is a cross-sectional diagram of a heat generator according to one embodiment of the present invention, in which a state of not discharging steam is shown.
Figure 4B:
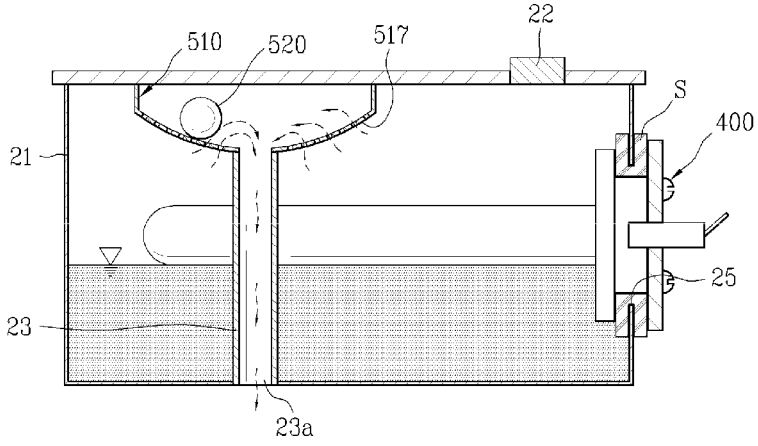
FIG. 4B is a cross-sectional diagram of a heat generator according to one embodiment of the present invention, in which a state of discharging steam is shown.
Figure 5:
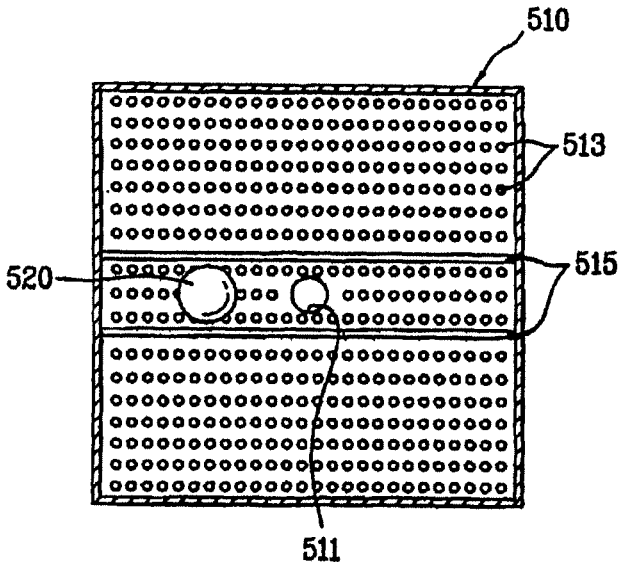
FIG. 5 is a layout of a steam discharge controller according to one embodiment of the present invention.

Referring to FIG. 4A and FIG. 4B, once a power is applied to the steam generator 20, water within the external case 21 turns into steam by the heat of the heating member of the heater 400.

Subsequently, the steam generated by the heating member may be introduced into the steam discharge case 517 via the perforated holes 513.

A user then does the cleaning of a floor by moving the head body back and forth.

In doing so, the mass member 520 moves within the internal space of the steam discharge case 510 together with the motion of the head body 100. In particular, the mass member 520 moves along the motion guide 515 of the steam discharge case 510.

If the moving mass member 520 deviates from a position of the case hole 511, the case hole 511 communicates with the outlet pipe 23. Therefore, the steam of the steam discharge case 510 moves along the outlet pipe 23 communicating with the case hole 511 and is then finally discharged outside the steam generator 20 via the steam outlet 23*a*.

Thereafter, if the user stops cleaning, i.e., if the user stops the motion of the head body 100, the mass member 520 in reciprocating along the motion guide 515 moves into a center of the incline 517. The mass member 520 then closes the case hole 511 communicating with the outlet pipe to prevent the steam from being discharged along the outlet pipe 23. As a result, the steam is not discharged externally via the steam outlet 23*a* anymore.

Figure 6A:
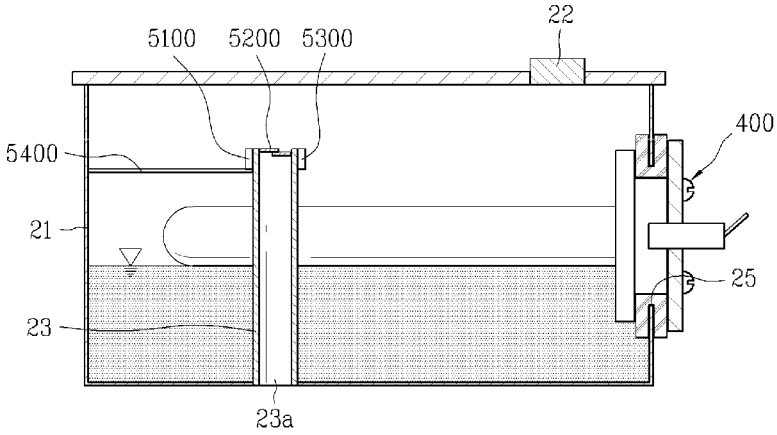
FIG. 6A is a cross-sectional diagram of a heat generator according to another embodiment of the present invention, in which a state of not discharging steam is shown.
Figure 6B:
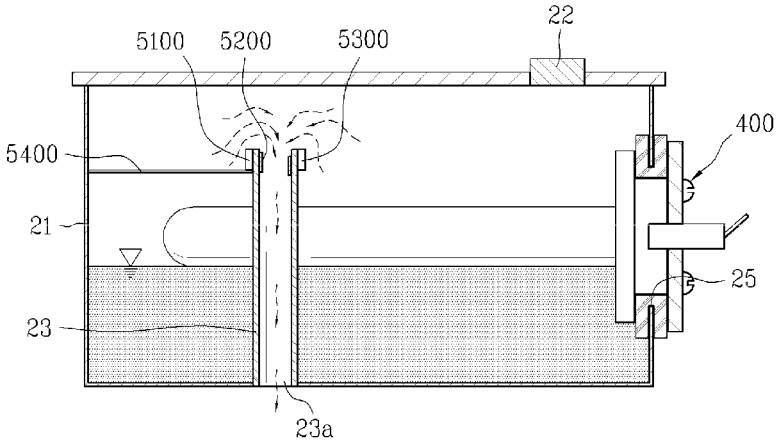
FIG. 6B is a cross-sectional diagram of a heat generator according to another embodiment of the present invention, in which a state of discharging steam is shown.

A configuration of a steam discharge controller provided to a steam generator according to another embodiment of the present invention and a process for controlling a presence or non-presence (i.e. absence) of a discharge of steam by the steam discharge controller are explained with reference to FIG. 6A and FIG. 6B as follows.

For example, similar to the former non-limiting embodiment of the present invention, a steam generator 20 according to another non-limiting embodiment of the present invention may include an external case 21 forming an exterior, a heater 400 to generate steam within the external case 21, and an outlet pipe 23 via which the steam may be discharged, of which detailed explanations are equivalent to those of the former embodiment of the present invention to be omitted.

The steam generator 20 according to the latter non-limiting embodiment of the present invention may include a steam discharge controller including a switching member 5200 opening/closing the outlet pipe 23, a driving device 5100 driving the switching member 5200 and a control unit (not shown in the drawings) controlling the driving device 5100. Additionally, the steam discharge controller may also include a pressure sensor 5300 that measures a steam pressure within the external case 21.

The switching member 520 may be provided on an upper end of the outlet pipe 23, and opens/closes the outlet pipe 23 by the driving device 5100. In this embodiment, the switching member 5200 may include a damper hinged to the upper end of the outlet pipe 23. Optionally, the switching member may include a valve. However, it should be appreciated that any device suitable for opening and closing the outlet pipe 23 may be utilized.

The driving device 5100 may include a motor controlling an operation of the switching member. In this regard, the driving device 5100 may be supported by a support member 5400 provided within the external case 21 and connected to an external environment by a connecting member (not shown in the drawings) provided to the support member 5400.

A measurement sensor may be provided within the external case 21 to measure a steam state within the external case 21. The measurement sensor may include a pressure sensor 5300 provided to one side of the upper end of the outlet pipe 23 to measure a steam pressure within the external case. Alternatively, the pressure sensor 5300 can be provided to any position of the external case 21. In order to measure the steam pressure, a measurement sensor excluding the pressure sensor 5300 can be used to calculate the steam pressure.

The control unit (not shown in the drawings) controls the driving device 5100 and the switching member 5200 based on the pressure measured by the pressure sensor 5300. For example, the control unit may open the switching member 5200 if the steam pressure measured by the pressure sensor 5300 is equal to or greater than a preset steam pressure, and the control unit may close the switching member 5200 if the steam pressure measured by the pressure sensor 5300 is smaller than a preset steam pressure.

A process for controlling a steam discharge in the steam generator 20 is explained as follows.

For example, a power may be applied to the steam generator 20, water within the external case 21 turns into steam by heat of the heating member of the heater 400.

In doing so, the pressure sensor 5300 provided within the external case 21 measures a pressure of the steam and then transfers the measured pressure to the control unit. As a result, the control unit decides (or determines) whether to open/close the outlet pipe 23, for example, whether to discharge the steam by comparing the measured steam pressure to the preset steam pressure.

In particular, if the measured steam pressure is greater than the preset steam pressure, the control unit may control the driving device 5100 by giving an order to open the outlet pipe 23. For example, if the switching member 5200 is in an open mode, the driving device 5100 maintains the open mode. If the switching member 5200 is in a closed mode, the driving device 5100, as shown in FIG. 6B, drives the switching member 5200 to open the outlet pipe 23.

On the other hand, if the measured steam pressure is smaller than the preset steam pressure, the control unit may control the driving device 5100 by giving an order to close the outlet pipe 23. For example, if the switching member 5200 is in an open mode, the driving device 5100, as shown in FIG. 6A, drives the switching member 5200 to close the outlet pipe 23. If the switching member 5200 is in a closed mode, the driving device 5100 maintains the closed state.

Of course, a user is able to give an order to control the switching member 5200 directly. For instance, a display device (not shown in the drawings) indicating a value of a measured steam pressure may be provided outside the external case 21. Therefore, a user is able to directly control a closing/opening of the outlet pipe 23 based on information displayed by the display device.

A method of controlling a cleaner using the steam generator 20 is explained with reference to FIG. 1, FIG. 2, FIGS. 6A and FIG. 6B as follows. In the following description, a case where a user performs both steam cleaning and vacuum cleaning is explained.

First of all, if a user activates a steam cleaning function and a vacuum cleaning function simultaneously, the steam generator 20 of the head body 100 and the air sucking device of the cleaner body 399 may be simultaneously driven. As a result, air containing particles (or debris) may be sucked into the cleaner body 300 via the air intake pipe 30, and the steam generator 20 keeps generating steam without discharging the generated steam until a steam pressure suitable for a steam cleaning is reached.

In doing so, the pressure sensor 5300 provided to the steam generator 20 measures a pressure of the generated steam. If the steam pressure reaches a preset steam pressure, the control unit opens the outlet pipe 23 of the steam generator 20, thereby resulting in the generated steam being discharged outside via the steam outlet 23*a* at a prescribed steam pressure. Thus, a user is able to perform both of the steam cleaning and the vacuum cleaning simultaneously by moving the head body 100 along a floor to be cleaned.

Of course, even if both of the steam and vacuum cleaning functions are simultaneously set, the steam generator 20 may be driven first to obtain a steam pressure suitable for steam cleaning.

If the steam generator 20 is driven first, steam is generated by the steam generator 20 without being discharged. In this regard, the pressure sensor 5300 provided to the steam generator 20 measures a pressure of the generated steam. If the stem pressure reaches a preset steam pressure, the control unit opens the outlet pipe 23 of the steam generator 20 and simultaneously drives the air sucking device of the cleaner body 300.

If the air sucking device is driven, air containing particles is sucked via the air intake pipe 30 and the steam generated from the steam generator 20 is externally discharged via the steam outlet 23*a*, simultaneously.

The user is able to drive the air sucking device 20 by confirming whether a steam pressure suitable for a steam cleaning is obtained from the steam generated from the steam generator 20 that was driven first. Whether the steam pressure reaches the preset steam pressure or not can be checked using the display device provided outside the steam generator 20.

Figure 7:
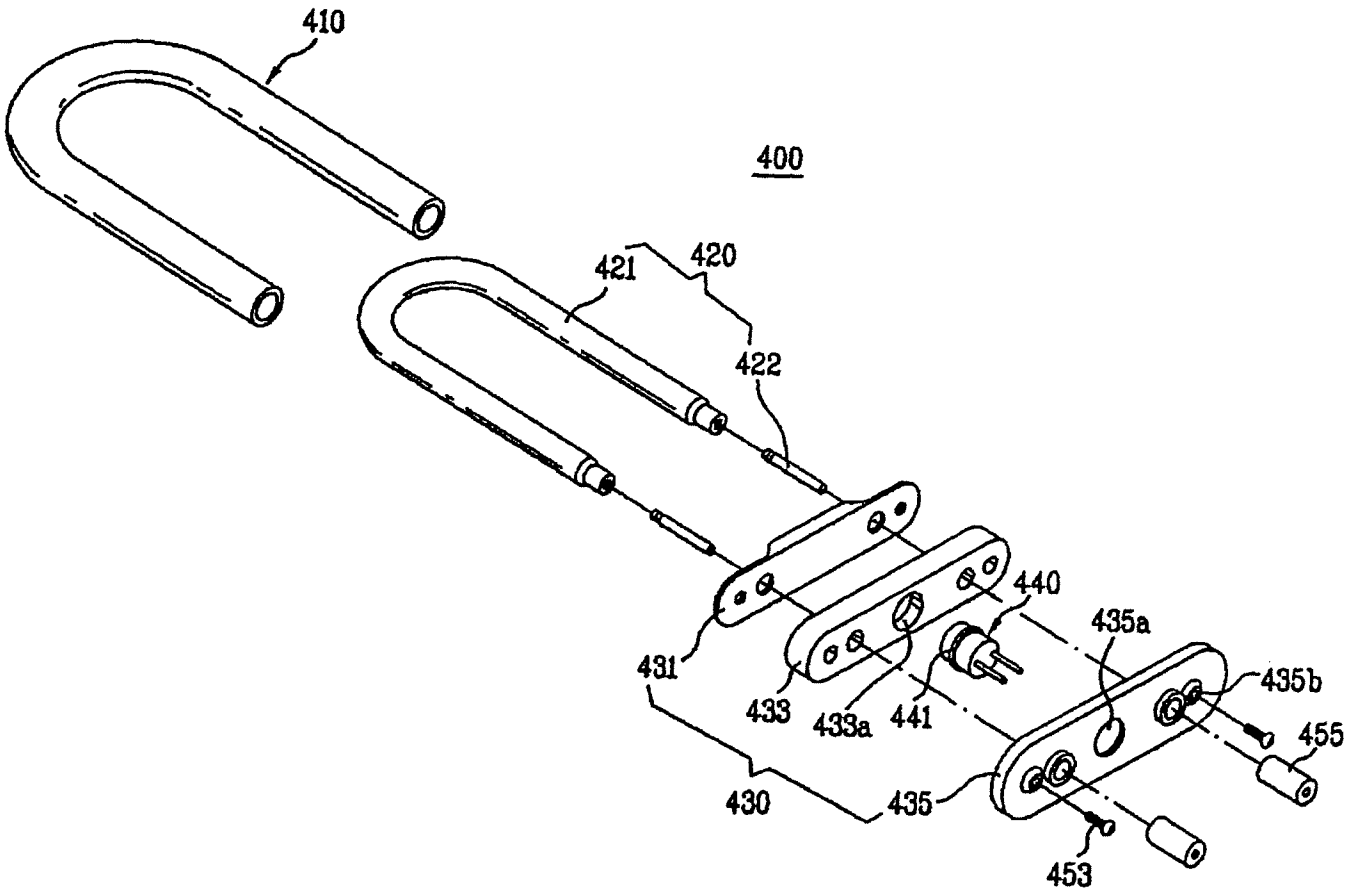
FIG. 7 is an exploded perspective diagram of a heating device according to one embodiment of the present invention.
Figure 8:
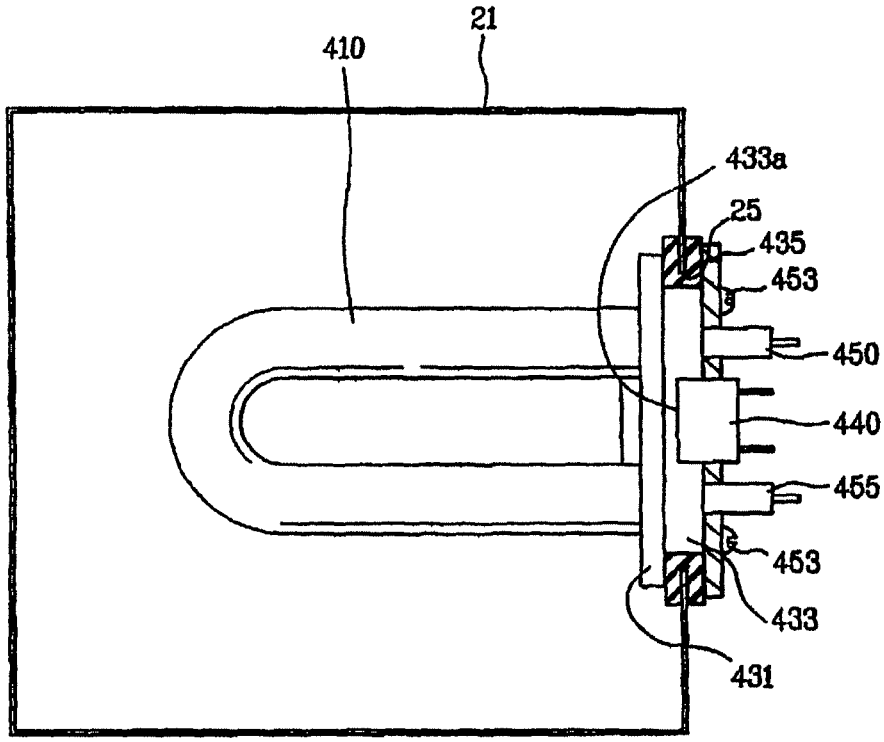
FIG. 8 is a layout of the heating device shown in FIG. 7.

FIG. 7 is an exploded perspective diagram of a heating device according to one embodiment of the present invention and FIG. 8 is a layout of the heating device shown in FIG. 7.

Referring to FIG. 7 and FIG. 8, a heater includes a heating member 420 to generate steam by heating water, a fixing part assembly fixing the heating member to the external case 21, a thermostat 440 provided to the fixing part assembly 430 to prevent the heating member 420 from being overheated, and a heat transfer member 410 transferring the heat of the heating member 420 to the thermostat 440.

The heating member 420 may include a heating part 421 and terminals 422 provided to both ends of the heating part 421. The terminals 422 may be connected to an external power source, and the heating part 421 may emit heat by being supplied with power via the terminals 422. One side of each of the terminals 422 may be connected to the heating part 421 and the other side may be connected to a terminal bolt 455 provided to a most outer side of the fixing part assembly 430.

The fixing part assembly 430 plays a role in fixing the heating member 420 to the external case 21 of the steam generator 20. The fixing part assembly 430 fixes the heating member 420 to the steam generator 20 such that the heating member 420 is fitted into the opening 25 provided to the external case 21. In this case, the heating member 420 penetrates the fixing part assembly 430. The terminals 422 are arranged in one side centering on the fixing part assembly, while the heating part 421 is arranged in the other side.

Additionally, the fixing part assembly 430 may include an intermediate connecting member 433. The intermediate connecting member 433 may be fitted into the opening 25 of the external case 21 and the terminals 422 of the heating member 420 may be installed to penetrate the intermediate connecting member 433. In order for the intermediate connecting member 433 to penetrate the opening of the external case 21 for the sealing between the intermediate connecting member 433 and the opening 25, a sealing member S can be provided between the intermediate connecting member 433 and the opening 25. The sealing member S may include a sealing rubber formed of a rubber based material. With this basic configuration, the heating member 420 can be stably loaded in the external case 21.

A process for detaching the intermediate connecting member 433 provided with the heating member 420 from the external case 21 is explained as follows.

First of all, if the heating member 420 is pulled out of the external case 21, the intermediate connecting member 433 escapes from the opening 25. Thus, it is not difficult to separate the heating member 420 from the external case 21. Further, if the intermediate connecting member 433 and the heating member 420 are inserted in the opening 25, as mentioned in the foregoing description, the intermediate connecting member is fitted into the opening 25 to be fixed thereto. So, the heating member 420 can be loaded (or mounted) in the external case 21 with ease.

As mentioned in the foregoing description, it is enough for the intermediate connecting member 433 to fix the heating member 420 to the external case 21. Yet, in the present invention, to raise the sealing power of the intermediate connecting member 433 and to fix the heating member 420 thereto more stably, a pressurizer may be provided.

The pressurizer completely prevents water from leaking via the opening 25 by pressing the intermediate connecting member 433 fitted into the opening 25 in front-to-rear directions. Additionally, the pressurizer may completely prevent the intermediate connecting member 433 from escaping from the opening 25 when the heating member 420 is completely loaded in the external case 21. In the following description, the pressurizer is explained in detail.

First of all, the pressurizer may include an inner bracket 431, an outer bracket 435 opposing the inner bracket 431 by leaving the intermediate connecting member 433 in-between, and a fastener connected to the inner and outer brackets 431 and 435 to fasten or unfasten the intermediate connecting member 433.

The inner bracket 431 may be provided within the external case 21, and may be penetrated by the heating member 420. Additionally, the inner bracket 431 may come into contact with one lateral side of the intermediate connecting member 433.

The outer bracket 435 may be provided outside the external case 21 and installed to come into contact with the other lateral side of the intermediate connecting member 433. The outer bracket 435 may be larger than the opening 25. The outer bracket 435 may be placed on the external case 21 to cover the opening 25. Further, an edge of the outer bracket 435 may be supported by an outer surface of the external case 21 in the vicinity of the opening 25. Of course, the edge of the outer bracket 435 can adhere closely to the sealing member S.

The fastener includes at least one screw 453 and at least one screw hole 435*b*. The screw 453 is installed to penetrate the inner bracket 431, the intermediate connecting member 433 and the outer bracket 435, simultaneously.

The screw hole 435*b* is provided to the outer bracket 435. And, a screw thread is formed in the screw hole 435*b*. And, a passing hole 431*a* is provided to each of the intermediate connecting member 433 and the inner bracket 431 to be penetrated by the screw 453. Of course, a screw thread can be provided to the passing hole 431*a* as well. The fastener is provided outside the outer bracket 435 and further includes a terminal bolt 455 locked to the terminal 422 of the heating member 420.

As mentioned in the foregoing description, once the fastener is fastened, the heater 400 according to the present invention is stably fixed to the external case 21. If the fastener is loosened, it is easy to externally separate the heater 400 from the external case 21. So, in case that the heater 400 is out of order or the heating member 420 needs to be replaced, repair or replacement of the heater 400 may be facilitated without disassembling the rest of the elements or parts of the cleaner.

Further, the thermostat 440 may be loaded in the fixing part assembly 430. In particular, the thermostat 440 penetrates the outer bracket 435 to be loaded (or mounted) in a loading part 433*a* of the intermediate connecting member 433.

A bracket hole 435*a* may be provided to a center of the outer bracket 435 to be penetrated by the thermostat 440. and, the loading part 433*a* may be recessed to enable one side end of the thermostat 440 to be fitted therein. The thermostat 440 can be forcibly fitted into the lading part 433*a* or locked to the loading part 433*a* by screw.

As the thermostat 440 is loaded in the loading part 433*a*, a contact area with the intermediate connecting member 433 may be extended, whereby heat of the intermediate connecting member 433 can be smoothly transferred to the thermostat 440. Thus, the thermostat 440 is able to precisely detect a temperature of the heating member 420 connected to the intermediate connecting member 433, thereby effectively preventing the heating member 420 from overheating.

A flange 411 is provided to a central rim of the thermostat 440. When the thermostat penetrates the outer bracket 435, the flange 441 is arranged to be placed between the intermediate connecting member 433 and the outer bracket 435.

Additionally, a front end portion of the thermostat 440 may be fitted into the bracket hole 435*a* from a rear side of the outer bracket 435, thus, the thermostat 440 is prevented from passing the bracket hole 435*a* since a diameter of the flange 441 is greater than that of the bracket hole 435*a*. Further, the above-arranged thermostat 440 may be stably fixed by the outer bracket 435 and the intermediate connecting member 433 when the fixing part assembly 430 is assembled.

Alternatively, the thermostat 440 may be installed to penetrate the intermediate connecting member 433. In this case, one side end portion of the thermostat 440 may come into contact with the inner bracket 431. However, it should be appreciated that any suitable arrangement for installing the thermostat 440 may be employed.

Further, the thermostat 440 may be electrically connected to the terminals 422 of the heating member 420. In this regard, the thermostat 440 may function as sort of an actuator driven by heat, e.g., the thermostat 440 may be configured to cut off electricity supplied to the terminals 422 when the heating member 420 is heated over a prescribed temperature. In other words, the thermostat 440 is activated by receiving heat of the heat member 420 to prevent the overheating of the heating member 420.

Alternatively, the thermostat 440 of the heater according to the present invention can be replaced by a sensor measuring a temperature of the heating member such as a thermistor or the like. In this case, the temperature sensor may be connected to the control unit to transfer a temperature of the heater to the control unit and a switch controlled by the control unit may be connected to the terminals of the heating member 420. Like the thermostat 440, the temperature sensor, the control unit and the switch are activated according to the temperature of the heating member 420 to prevent the overheating of the heating member 420.

The heat transfer member 410 transfers heat of the heating member 420, and more particularly, the heat of the heating part 421 to the thermostat 440 through heat conduction. Additionally, the heat transfer member 410 may formed of a metal based material of high heat transfer capability such as Al and the like. In this regard, it should be appreciated that any material or configuration having relatively high heat transfer capabilities may be employed.

Accordingly, the present invention provides the following effects or advantages.

First of all, a steam pressure suitable for a steam cleaning may be maintained by installing a steam discharge controller in a manner of discharging steam in case of performing the steam cleaning only. Additionally, by closing a steam outlet in case of not performing a steam cleaning, it is able to prevent smell or water within a steam generator from leaking.

Secondly, it is able to precisely measure a temperature of a heating member by installing a thermostat in the vicinity of the heating member. Hence, the overheating of the heating member can be effectively prevented.

Thirdly, by providing a heater including a heating member and a thermostat as one assembly, the heater can be easily loaded/unloaded in/from a steam generator or cleaner. Hence, assembly productivity is enhanced and repair is facilitated.

It is further noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A steam generator provided in a head body of a cleaner, comprising:

an external case having an opening that allows an internal space of the external case to communicate with an external environment, and a supplier that supplies water to the internal space;

a heater provided proximate the opening to generate steam;

an outlet pipe having a first side that communicates with the external environment, and is configured to discharge steam generated by the heater outside the external case, wherein a lower end of the outlet pipe is connected on a bottom side of the external case so as to discharge steam through a bottom side of the head body; and a steam discharge controller provided proximate a second side of the outlet pipe to open/close the outlet pipe according to a presence or absence of a steam discharge.

2. The steam generator of claim 1, wherein the steam discharge controller further comprises a pressure sensor measuring a steam pressure within the case.

3. A cleaner including the steam generator of claim 1, the cleaner comprising:

a cleaning member provided beneath a steam outlet of an outlet pipe;

a cleaner body configured to suck air and operate independently of the steam generator; and a dust collector detachably coupled to the cleaner body, wherein the dust collector is configured to separate particles from the sucked air.

4. The steam generator of claim 1, wherein the heater comprises:

a heating member that heats water to generate steam;

a fixing assembly that fixes the heating member to the external case to seal the opening;

a thermostat loaded in the fixing assembly, and configured to prevent overheating of the heating member; and a heat transferor that transfers heat of the heating member to the thermostat.

5. The steam generator of claim 4, further comprising a seal provided between the opening and the fixing assembly to seal therebetween.

6. The steam generator of claim 4, wherein the fixing assembly comprises:

an inner bracket provided outside the external case;

an intermediate connector fitted into the opening such that the intermediate connector is provided between the inner and outer bracket; and a fastener connected to the inner and outer brackets.

7. The steam generator of claim 6, wherein a loading recess, which is configured to receive the thermostat therein, is provided on the intermediate connector.

* * * * *